US007552918B2

(12) United States Patent
Blackwell et al.

(10) Patent No.: US 7,552,918 B2
(45) Date of Patent: Jun. 30, 2009

(54) VERTICAL JUSTIFICATION SYSTEM

(75) Inventors: Wayne M. Blackwell, Chenango Forks, NY (US); Jamie R. Swetland, Gillett, PA (US)

(73) Assignee: Lockheed Martin Corporation, Bethesda, MD (US)

( * ) Notice: Subject to any disclaimer, the term of this patent is extended or adjusted under 35 U.S.C. 154(b) by 65 days.

(21) Appl. No.: 11/680,329

(22) Filed: Feb. 28, 2007

(65) Prior Publication Data

US 2007/0145663 A1 Jun. 28, 2007

Related U.S. Application Data

(63) Continuation of application No. 11/007,216, filed on Dec. 9, 2004, now Pat. No. 7,201,369.

(51) Int. Cl.
*B65H 5/00* (2006.01)

(52) U.S. Cl. ..... 271/10.06; 271/10.07; 271/10.12; 271/251; 271/253

(58) Field of Classification Search ..... 271/10.06, 271/10.07, 10.12, 251, 250, 253
See application file for complete search history.

(56) References Cited

U.S. PATENT DOCUMENTS

| | | | | | |
|---|---|---|---|---|---|
| 3,980,296 | A | | 9/1976 | Craft et al. | |
| 3,988,017 | A | * | 10/1976 | Kyhl | 271/111 |
| 4,045,018 | A | | 8/1977 | Michelson | |
| 4,083,555 | A | | 4/1978 | Irvine et al. | |
| 4,155,440 | A | | 5/1979 | Bogdanski et al. | |
| 4,248,151 | A | * | 2/1981 | Real | 101/288 |
| 4,257,587 | A | | 3/1981 | Smith | |
| 4,448,407 | A | * | 5/1984 | Bashford et al. | 271/228 |
| 4,506,878 | A | * | 3/1985 | Bashford | 271/227 |
| 4,615,519 | A | | 10/1986 | Holodnak et al. | |
| 4,723,773 | A | * | 2/1988 | Westover et al. | 271/10.07 |
| 4,744,554 | A | | 5/1988 | Kulpa et al. | |
| 4,877,229 | A | | 10/1989 | Delbe et al. | |
| 5,012,915 | A | | 5/1991 | Kristola et al. | |
| 5,109,975 | A | | 5/1992 | Prettie | |
| 5,197,729 | A | * | 3/1993 | Couper | 271/248 |
| 5,238,236 | A | | 8/1993 | Belec et al. | |
| 5,253,862 | A | | 10/1993 | Acquaviva et al. | |
| 5,443,253 | A | | 8/1995 | Dale et al. | |
| 5,507,479 | A | | 4/1996 | Martin et al. | |
| 5,560,598 | A | | 10/1996 | Goldkuhle | |
| 5,657,983 | A | * | 8/1997 | Fisk | 271/251 |
| 5,755,437 | A | | 5/1998 | Ek | |
| 6,059,284 | A | | 5/2000 | Wolf et al. | |
| 6,164,643 | A | * | 12/2000 | Otsuka | 271/250 |
| 6,273,418 | B1 | | 8/2001 | Fujikura et al. | |
| 6,338,483 | B1 | | 1/2002 | Andela et al. | |
| 6,422,555 | B1 | | 7/2002 | Cruz et al. | |
| 6,517,308 | B1 | | 2/2003 | Eggebrecht et al. | |
| 6,536,756 | B2 | | 3/2003 | Stefan et al. | |
| 6,666,324 | B2 | | 12/2003 | Engarto et al. | |
| 6,942,214 | B2 | * | 9/2005 | Riccardi | 271/227 |

* cited by examiner

*Primary Examiner*—David H Bollinger
(74) *Attorney, Agent, or Firm*—Greenblum & Bernstein P.L.C.

(57) ABSTRACT

A device and system for registering or justifying product such as mail pieces in a vertical position for future processing of such mail pieces. The system includes a mounting block having an angled bore and a driven alignment mechanism mounted within the angled bore. The driven alignment mechanism includes a shaft assembly mounted in the angled bore such that the shaft assembly is at approximately a same angle as the angled bore. At least one surface is mounted to the shaft assembly which, when contacting a product, is driven and provides a downward correction vector to the product for vertically aligning the product.

23 Claims, 3 Drawing Sheets

VERTICAL JUSTIFICATION SYSTEM

CROSS REFERENCE TO RELATED APPLICATIONS

This application is a continuation of copending U.S. application Ser. No. 11/007,216, filed on Dec. 9, 2004, the contents of which are incorporated by reference in their entirety herein.

BACKGROUND OF THE INVENTION

1. Field of the Invention

The invention generally relates to a justification system and, more particularly, to a vertical justification device for vertically aligning skewed product or misaligned product for subsequent processing.

2. Background Description

The sorting of mail is a very complex, time consuming task. In general, the sorting of mail is processed though many stages, including back end processes, which sort or sequence the mail in delivery order sequence. These processes can either be manual or automated, depending on the mail sorting facility, the type of mail to be sorted such as packages, flats, letter and the like. A host of other factors may also contribute to the automation of the mail sorting, from budgetary concerns to modernization initiatives to access to appropriate technologies to a host of other factors.

In general, however, most modem facilities have taken major steps toward automation by the implementation of a number of technologies. These technologies include, amongst others, feeding devices, letter sorters, parcel sorters, advanced tray conveyors, flat sorters, optical recognition systems, singulators and the like. As a result of these developments, postal facilities have become quite automated over the years, considerably reducing overhead costs.

But, in implementation, certain automations may require additional attention in order to efficiently process the mail pieces (product). For example, currently, it is known to induct letters, flats and products, in general, into a sorting system using feeders. To accomplish this induction, the products are first vertically stacked near a conveying system. The product are then fed into the conveying system, at which time indicia such as, for example, delivery destination information, is printed (e.g., sprayed) on a surface of the product. This information may be in the form of bar coding or the like. The delivery destination information is then read by one or more scanners, for example, to then be reconciled by a controller for future sorting, sequencing or other processing of the product, e.g., sequencing the product into walk order sequence.

Prior to spraying or printing the delivery information on the product, the product must be vertically justified with respect to an edge of the product. This will ensure that the indicia will be properly aligned on the product. If, however, the indicia are not properly aligned on the product, e.g., partially sprayed on the product, misaligned on the product, etc., the reading device will not be able to read such information and, in turn, the system will not be able to reconcile such information for sequencing or further processing. In these situations, the product will be ejected into a reject bin for manual sort, which decreases, considerably, the efficiency of the sorting and sequencing system.

Currently, to align a skewed product or "drive" the product onto the transport deck of the system, a traditional leveler is provided with the feeder. The traditional leveler is a front end system which includes opposing, vertically aligned belts, usually in length of two or three feet depending on the induction speed of the system. The belts are separated from one another in order to allow skewed or other incorrectly fed product to be inducted therebetween. In this manner, for example, as the skewed product passes through the opposing, vertically aligned belts, the product will settle, e.g., fall, due to gravity. By the time the product exists the system, the product should be vertically aligned on a transport deck or ledge of the system, on one edge.

However, there are disadvantages to these traditional leveler systems. For example, the opposing, vertically aligned belts are of a considerable length in order to allow gravity to align the product. This is especially true in cases of increased feeder throughput, where the induction speed of the product is increased. Basically, in these situations, the opposing, vertically aligned belts must be lengthened in order to allow the product to settle due to gravity. This is simply because the induction speed of the product has increased which, in turn, requires additional processing time for the product to settle. This, of course, increases the footprint of the system, even more, thus requiring additional warehouse or processing floor space.

Additionally, traditional levelers have difficulty justifying or registering lighter product. For example, the lighter product have a tendency to float between the opposing belts. Because of this floating phenomenon, regardless of the length of the leveler, some product will never become justified onto the transport deck. Also, these lighter product also have a tendency to "cling" to one of the belts, in which case the product again is not properly registered. In any of these situations, the processing of the product will be affected, which will affect the overall processing throughput of the system.

The invention is directed to overcoming one or more of the problems as set forth above.

SUMMARY OF THE INVENTION

In a first aspect of the invention, a device for vertically aligning product includes a mounting block having an angled bore and a driven alignment mechanism mounted within the angled bore. The driven alignment mechanism includes a shaft assembly mounted in the angled bore such that the shaft assembly is at approximately a same angle as the angled bore. At least one surface is mounted to the shaft assembly which, when contacting a product, provides a substantially downward correction vector, which may be at an angle, to the product for vertically aligning the product.

In another aspect of the invention, a system for aligning product includes a driven alignment mechanism positioned at an angle of greater than 0 degrees from the vertical in a direction of product travel. The driven alignment mechanism includes a shaft assembly and at least one freely rotating assembly mounted to the shaft assembly. A drive mechanism opposes the driven alignment mechanism and drives the freely rotating assembly when a product passes between the drive mechanism and the freely rotating assembly.

In yet another aspect of the invention, a system for aligning mail pieces includes a driven alignment mechanism mounted within an angled bore. The driven alignment mechanism includes a shaft assembly and at least one freely rotating surface mounted to the shaft assembly. A driving conveyor system is positioned proximate the driven alignment mechanism and includes a first belt drive and a second, opposing belt drive. The at least one freely rotating surface is positioned proximate the second, opposing belt drive such that mail pieces being transported by the second, opposing belt drive and passing between the second, opposing belt drive and the at least one freely rotating surface drives the at least one freely rotating surface. The at least one freely rotating surface, when contacting the mail pieces, provides a downward correction vector to the mail pieces for vertically aligning the mail pieces.

BRIEF DESCRIPTION OF THE DRAWINGS

The foregoing and other aspects and advantages will be better understood from the following detailed description of embodiments of the invention with reference to the drawings, in which.

DETAILED DESCRIPTION OF EMBODIMENTS OF THE INVENTION

The invention is directed to a justification device and more particular to a device or system capable of vertically aligning products such as, for example, flats and other mail items (i.e., product), into vertically aligned positions for future processing, delivery or warehousing. In aspects of the invention, the product may be inducted into the system in a vertical orientation, with some or all of the product being skewed or inducted above the transport deck. In aspects of the invention, the product will be vertically justified in a minimal amount of space, decreasing the current footprint of known systems.

The system of the invention significantly reduces processing times for sequencing both flats and mail pieces or other disparate products in delivery point sequence using, in embodiments, a skew mechanism. The skew mechanism is easily retrofitted onto known systems, and can be easily adapted to any known product induction speed, while vertically aligning the product without the need to increase the footprint of the system. In fact, by using the skew mechanism, the footprint of known leveler systems can be significantly reduced, upwards of 50% or more. The skew mechanism is adjustable and may be a passive device driven by current belt drives used in a feeding system. Other applications such as warehousing and storage applications are also contemplated for use with the invention.

System of the Invention

Figure 1:
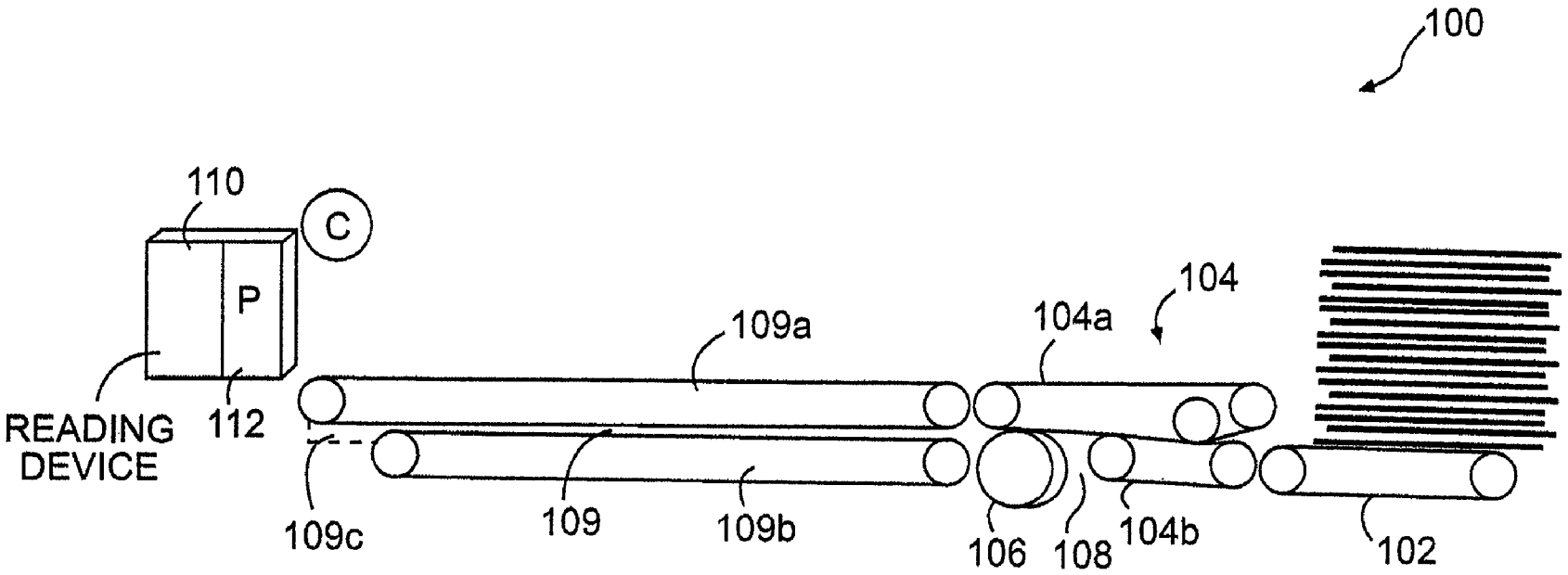
FIG. 1 shows a top view of the vertical justification device and accompanying components in accordance with a first aspect of the invention.

Referring now to FIG. 1, a general schematic diagram of the vertical justification system of the invention is shown. In the embodiment of FIG. 1, the vertical justification system is depicted as reference numeral 100 and includes a first feeder or conveyor 102 and a second, feeder or conveyor 104. In embodiments, the first feeder 102 is a belt drive, and the second feeder 104 is a pair of opposing belt drives 104*a* and 104*b*, with belt drive 104*b* having a shorter length than that of belt drive 104*a*. In one application, the feed rate capacity of the belt drives may be approximately 40,000 letters per hour and approximately 10,000 flats per hour. Those of ordinary skill in the art should recognize, though, that other feeding capacity rates may also be used with the invention, and the feeding capacity described herein is provided for illustrative purposes.

Still referring to FIG. 1, an adjustment mechanism (e.g., skew adjustment mechanism) 106 is positioned at a distal end of the belt drive 104*b*, and opposed to the belt drive 104*a*. In one embodiment, the skew adjustment mechanism 106 is separated from the belt drive 104*a* by approximately 1-2 mm in order to allow product to pass therebetween. However, it should be recognized that the distance between the skew adjustment mechanism 106 and the belt drive 104*a* may vary depending on the particular application. The skew adjustment mechanism 106 may also be adjustable by, for example, being spring loaded or of a semi compliant material such as polyurethane, in order to adjust a distance between the skew adjustment mechanism 106 and the belt drive 104*a*.

In one aspect of the invention, the skew adjustment mechanism 106 is comprised of one or more rollers 106*a* axially mounted to a shaft assembly 122*a*. The one or more rollers 106*a* may, in one embodiment, be composed of semi compliant material in order to adjust a distance between the skew adjustment mechanism 106 and the belt drive 104*a*. The rollers 106*a* may be freely rotatable about the shaft, which is adjustable to tilt at different angles with respect to a transport deck 108 of the system 100. The rollers may equally be representative of a belt, band, stationary or rotating low friction surface or other conveying device. The rollers 106*a* may be passive rollers driven by the belt drives 104*a* and 104*b*, and more particularly, by the product passing between the belt drive 104*a* and the skew adjustment mechanism 106. The components of the skew adjustment mechanism 106 are discussed in more detail with respect to FIG. 3.

A leveler system 109 is positioned at a remote end of the belt drive 104*a*, and proximate the skew adjustment mechanism 106. The leveler system 109 includes opposing belts 109*a* and 109*b* and a flat conveying belt 109*c* (transport deck), orthogonally positioned with respect to the opposing belts 109*a* and 109*b*. In this application, the footprint of a traditional leveler system can be significantly reduced from two or more feet to one foot in length or less. This will significantly decrease the required flooring space required for the system of the invention.

A camera, optical reading device or other type of reading device 110 and/or printer 112, are positioned downstream of the leveler system 109. A control "C" may also be used with the system 100 in order to control the timing of the printing and reading of the product. In embodiments, the camera or reading device is designed to read the delivery point or other pertinent product information provided on each product. In further aspects of the invention, the product information is first sprayed or printed by the printer and, after a second or subsequent pass through the system, read by the camera or other reading device and reconciled by the controller "C", in a known manner.

Figure 2:
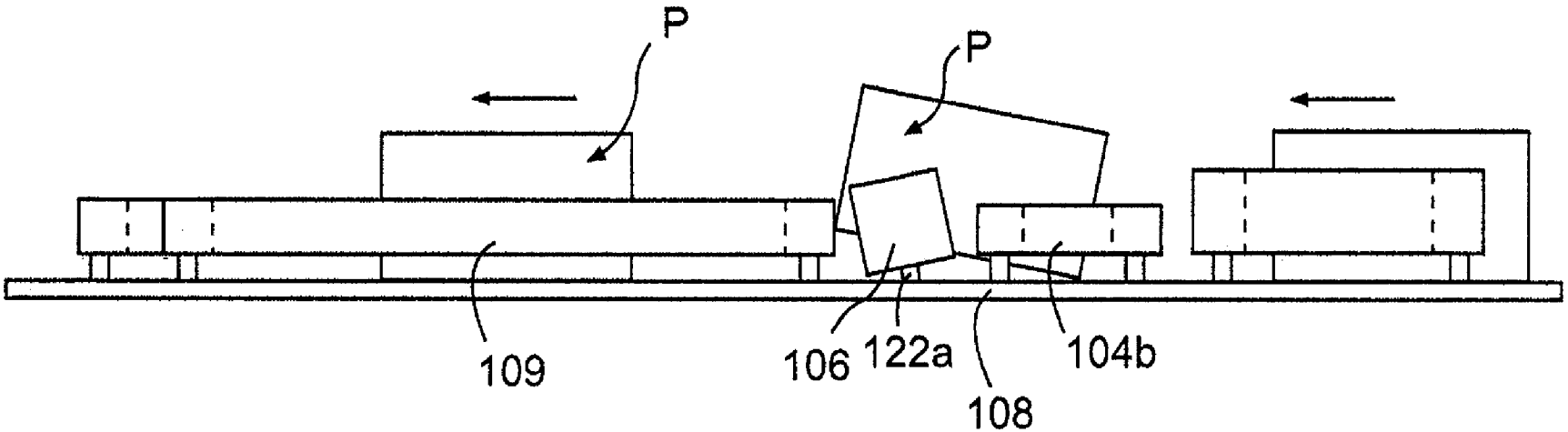
FIG. 2 shows a side view of the vertical justification device and accompanying components in accordance with a first aspect of the invention.

FIG. 2 shows a side view of the system 100. In this view, it is shown that the skew adjustment mechanism 106 is positioned at an angle with respect to the other components of the system 100. In this manner, product "P" will be directed downwards, towards the transport deck as the product passes by the skew adjustment mechanism 106. The skew adjustment mechanism 106 is initially a passive device, in one embodiment, and is driven or powered by the general flow of the product.

Figure 3:
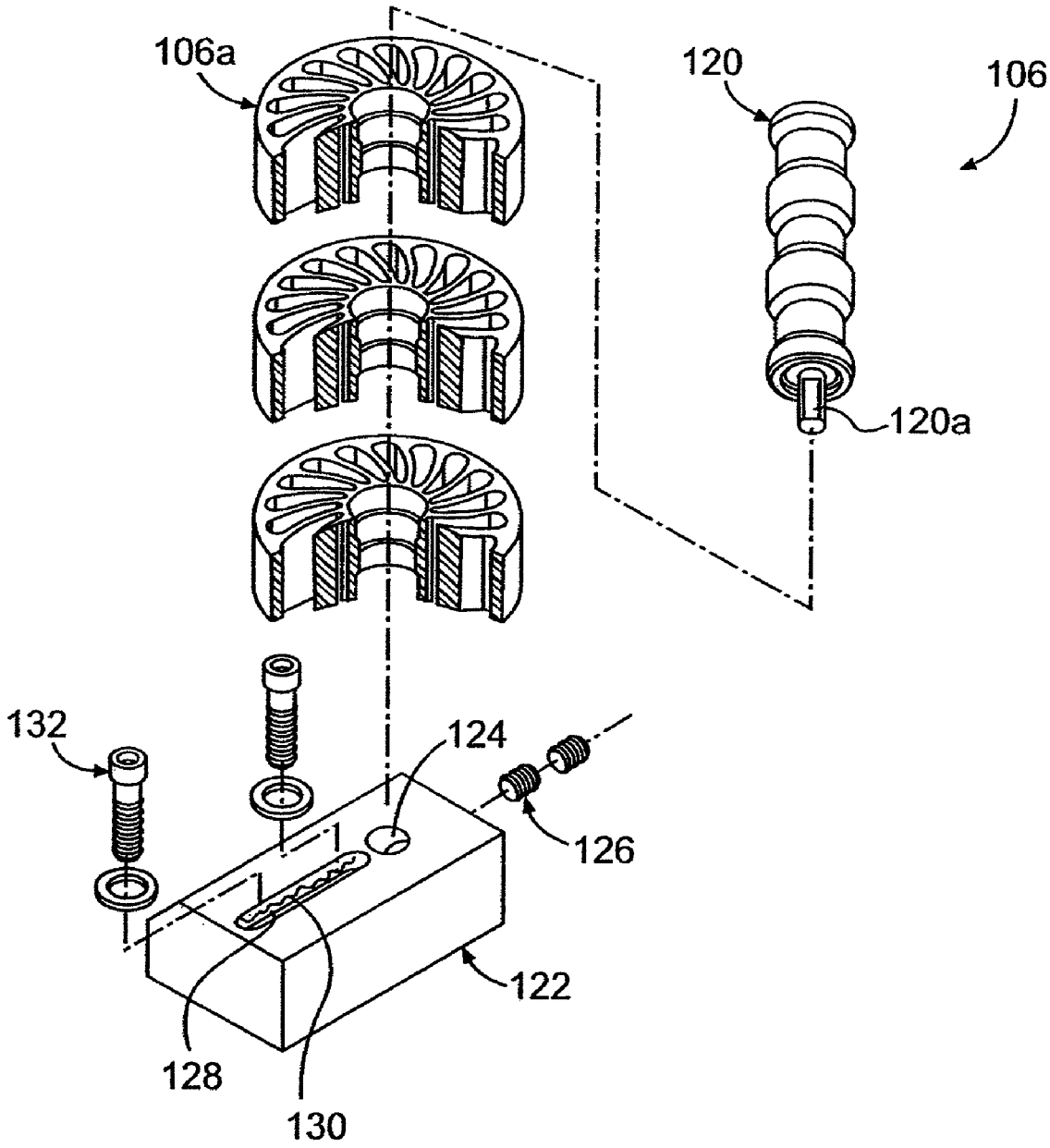
FIG. 3 is an exploded view of the vertical justification device in accordance with the invention.

FIG. 3 shows an exploded view of the skew adjustment mechanism 106. In this aspect of the invention, the skew adjustment mechanism 106 includes a roller assembly 120, preferably a shaft, mounted within a mounting block 122 and including rollers 106*a*. These rollers 106*a* may be comprised of semi compliant materials. In one aspect of the invention, the shaft 120 includes a several different diameters, one of which is a smaller diameter for engaging within an angled bore 124 of the mounting block. In this embodiment, the smaller diameter of the shaft will include a flat surface 120*a* for engaging with set screw 126 which fixes the shaft to the mounting block 122.

The angled bore 124 may be at an angle of approximately 15 degrees from vertical; however, the angle may be range from slightly greater than 0 degrees to slightly less than 45 degrees from the vertical in a direction of product travel. This angle will permit the roller assembly 120 to be seated within the angled bore at such an angle. One or more rollers 106*a* are freely rotatable about the shaft, although a belt or other mechanism may be mounted to the shaft.

In another aspect of the invention, an angled slot 128 may be provided within the mounting block 122. The angled slot 128 allows the shaft to be adjustable mounted on the mounting block 122 at several predetermined angles ranging from slightly greater than 0 degrees to about 45 degrees from vertical, although other angles are also contemplated by the invention. The shaft may be adjustable via many types of mechanism such as, for example, a rack and pinion geared system, a belt, a locking screw, a pawl system and the like, generally represented as reference numeral 130. The mounting block 122 is mounted to the system 100 and preferably a portion of the transport deck via bolts 132 or other fastening mechanism.

Method of Using the of the Invention

In one use, the product is initially inducted into the system, generally in a vertical orientation. However, at this operational stage, the product may be skewed (i.e., the front and rear edges of the product are not in vertical alignment) or positioned above the transport deck. As the product passes the skew adjustment mechanism, the skew adjustment mechanism applies a predetermined downward angled force, depending on the angle of the skew adjustment mechanism. In this manner, if the product is traveling above the transport deck or is skewed, the change in vector will be provided by the skew adjustment mechanism 106 thus forcing the product into or close to the proper orientation prior to entering into the leveler system. That is, the skew adjustment mechanism 106 will provide a downward correction vector to the product, which in one embodiment is an angled downward correction vector. Once in the leveler section, the product will be allowed to settle, if necessary, to correctly orient the product for future processing.

This implementation provides a significant total realized throughput increase of the system; that is, accelerates the correction process compared to a traditional leveling system, alone. In addition, the skew adjustment mechanism will ensure that any product, regardless of the induction speed, will be correctly registered or vertically justified onto the transport deck for future processing (e.g., printing and reading of product information). Also, the skew adjustment mechanism will prevent the lighter product from floating between the opposing belts of the leveler system, in addition to preventing the lighter product from clinging to a belt of the leveler system. This is due, in part, to the downward forces applied by the skew adjustment mechanism on the product prior to entering into the leveler system. Lastly, the use of the skew adjustment mechanism 106 will significantly decrease the size of the leveler section.

While the invention has been described in terms of embodiments, those skilled in the art will recognize that the invention can be practiced with modification within the spirit and scope of the appended claims.

It is claimed:

1. A device for vertically aligning product, comprising a vertically angled alignment mechanism with respect to a direction of travel comprising a freely rotating shaft assembly which is adapted to interact with a drive mechanism to align a product in a vertical manner, wherein the vertically angled alignment mechanism comprises a mounting block having an angled bore and the freely rotating shaft assembly is a driven alignment mechanism mounted within the angled bore.

2. The device of claim 1, wherein the driven alignment mechanism, comprises:

a shaft mounted in the angled bore such that the shaft is at approximately a same angle as the angled bore; and at least one surface mounted to the shaft which, when contacting the product, provides an approximate downward correction vector to the product for vertically aligning the product.

3. The device of claim 2, wherein the at least one surface includes at least one roller, freely rotating on the shaft such that the product drives the at least one roller when in contact.

4. The device of claim 3, wherein the at least one roller is at least two rollers.

5. The device of claim 1, wherein the at least one surface is a belt or band.

6. The device of claim 1, wherein the freely rotating shaft assembly is at an angle from approximately greater than 0 degrees to approximately less than 45 degrees from the vertical.

7. The device of claim 1, wherein the freely rotating shaft assembly is approximately at an angle of 15 degrees from the vertical.

8. The device of claim 1, wherein the angled bore is a slot for adjustably mounting the shaft to the mounting block.

9. The device of claim 8, further comprising a rack and pinion geared system, a belt, a locking screw or a pawl system to adjust the shaft within the slot.

10. The device of claim 1, wherein the freely rotating shaft assembly comprises at least one surface applying a predetermined downward angled force on the product to direct the product in vertical alignment such that a downward correction vector is an angled downward correction vector.

11. The device of claim 1, wherein the product is a mail piece.

12. The device of claim 1, wherein the freely rotating shaft assembly includes one or more rollers freely rotatable about an adjustable shaft.

13. The device of claim 12, wherein the adjustable shaft is fixed from rotating.

14. The device of claim 1, wherein the freely rotating shaft assembly is a passive assembly.

15. A device for vertically aligning product, comprising a vertically angled alignment mechanism with respect to a direction of travel comprising a freely rotating shaft assembly which is adapted to interact with a drive mechanism to align a product in a vertical manner, wherein the drive mechanism comprises:

a first conveyor; and a second conveyor being positioned proximate the first conveyor and the freely rotating shaft assembly, the second conveyor comprising:

a first belt drive having a first length, and a second, opposing belt drive having a second length less than the first length, and the freely rotating shaft assembly is positioned proximate a distal end of the second belt drive and driven by the first belt drive via a transfer of motion by the product passing between the freely rotating shaft assembly and the second, opposing belt.

16. The device of claim 15, further comprising a leveler system positioned proximate the freely rotating shaft assembly and at an end of the first belt drive, the leveler system including opposing belts and a flat conveying belt, orthogonally positioned with respect to the opposing belts.

17. A system for aligning product, comprising:

a vertically angled alignment mechanism with respect to a direction of travel, the vertically angled alignment mechanism comprising a freely rotating shaft assembly; and a drive mechanism driving the freely rotating assembly when a product passes between the drive mechanism and the freely rotating shaft assembly, wherein the drive mechanism comprises:

a conveyor positioned proximate the first conveyor and the vertically angled alignment mechanism, the conveyor comprising:

a first belt drive having a first length, and a second, opposing belt drive having a second length less than the first length, the vertically angled alignment mechanism being positioned proximate a distal end of the second belt drive and opposing a side of the first belt drive.

18. The system of claim 17, wherein the freely rotating shaft assembly includes at least one roller.

19. The system of claim 18, wherein the freely rotating shaft assembly applies a predetermined downward angled force on the product to direct the product in a vertical alignment on a transportation deck.

20. The system of claim 17, wherein the product is a mail piece.

21. A system for aligning product, comprising:

a vertically angled alignment mechanism with respect to a direction of travel, the vertically angled alignment mechanism comprising a freely rotating shaft assembly; and a drive mechanism driving the freely rotating assembly when a product passes between the drive mechanism and the freely rotating shaft assembly, wherein:

the freely rotating shaft assembly includes at least one roller, and the freely rotating shaft assembly includes a mounting block having an angled bore in which a shaft of the freely rotating shaft assembly is mounted therein, the angled bore ranging from approximately greater than 0 degrees to approximately less than 45 degrees from the vertical, wherein the angled bore is a slot for adjustably mounting the shaft assembly to the mounting block.

22. A device for vertically aligning product, comprising a vertically angled alignment mechanism with respect to a direction of travel comprising a freely rotating shaft assembly which is adapted to interact with a drive mechanism to align a product in a vertical manner, wherein the freely rotating shaft assembly includes one or more rollers freely rotatable about an adjustable shaft and the adjustable shaft includes two or more different diameters.

23. A device for vertically aligning product, comprising a vertically angled alignment mechanism with respect to a direction of travel comprising a freely rotating shaft assembly which is adapted to interact with a drive mechanism to align a product in a vertical manner, wherein the freely rotating shaft assembly is a passive assembly, remote from the drive mechanism and driven by an object passing through the drive mechanism.

* * * * *